US006322182B1

(12) United States Patent
Lin et al.

(10) Patent No.: US 6,322,182 B1
(45) Date of Patent: Nov. 27, 2001

(54) METHOD AND APPARATUS OF IDENTIFYING INK STORED IN AN INK-JET CARTRIDGE

(75) Inventors: Chen-Hua Lin; Dong-Sang Chiang; Ji-Chen Wu, all of Hsinchu (TW)

(73) Assignee: WiserTek International Corp., Hsinchu (TW)

( * ) Notice: Subject to any disclaimer, the term of this patent is extended or adjusted under 35 U.S.C. 154(b) by 0 days.

(21) Appl. No.: 09/408,072

(22) Filed: Sep. 29, 1999

(51) Int. Cl.[7] ..... B41J 2/195
(52) U.S. Cl. ..... 347/7; 347/19; 400/703
(58) Field of Search ..... 347/7, 19, 100; 400/703

(56) References Cited

U.S. PATENT DOCUMENTS 5,289,211 * 2/1994 Morandotti et al. ..... 347/7
5,682,184 * 10/1997 Stephany et al. ..... 347/7
5,992,961 * 11/1999 Ishikawa et al. ..... 347/7
5,992,986 * 11/1999 Gyotoku et al. ..... 347/85

FOREIGN PATENT DOCUMENTS

4009808-A1 * 8/1990 (DE) ..... 347/7

* cited by examiner

*Primary Examiner*—Daniel J. Colilla
(74) *Attorney, Agent, or Firm*—Birch, Stewart, Kolasch & Birch, LLP

(57) ABSTRACT

Method and apparatus of identifying ink stored in an ink-jet cartridge are to change the electrical property such as resistance or capacitance of the ink and to cooperate with a detector to achieve the goal of identifying ink. The method comprises: adding special additive such as salt additive or acid additive into the ink or changing the ratio of the components in the ink, and further providing a detector for detecting the electrical property of the ink and doing logical judgment to identify whether the ink stored in the ink-jet cartridge is the original factory ink or not. The preferred embodiment of the apparatus of identifying ink in ink-jet cartridge is to form the detector on the IC of the print head directly to achieve the goal stating above of detecting the electrical property of the ink stored in the ink-jet cartridge.

24 Claims, 7 Drawing Sheets

METHOD AND APPARATUS OF IDENTIFYING INK STORED IN AN INK-JET CARTRIDGE

BACKGROUND OF THE INVENTION

1. Field of the Invention

The present invention relates to a method and an apparatus of identifying ink stored in an ink-jet cartridge for an ink-jet printing device for identifying and ensuring ink stored in an inkjet printing device is the original factory ink or not.

2. Related Art

Ink-jet printers have been widely used for providing high quality printing on any paper. They have such features as energy saving, printing fast without any noise, good portability as being compact, and, in particular, easy to manufacture. Thus, they are popular for personal or office uses.

Nevertheless, the ink-jet cartridge design is the most important one in the ink-jet printer manufacturing. Generally, the ink-jet cartridge contains an ink reservoir, a print head, and an ink supply port or an ink passage between the ink reservoir and the print head. In some designs, there is an additional ink chamber. Aside from those, it also contains the ink for printing.

It is very popular in the market to use the device of the refill ink for re-filling an ink-jet cartridge. However, in the aspect of the customers, it will cause the print head damage by using the refill ink and in the aspect of the manufacturers, it will be the disadvantages of the customers' using the refill ink and lowering the amount of using the print head. Therefore, developing an apparatus of identifying ink stored in an ink-jet cartridge and an identifiable ink is surely necessary to satisfy the above reasons.

The ink can be classified into the dye type and the pigment type. In terms of its composition, the ink contains: (1) water, which is about 70% to 80% by weight; (2) dye; (3) solvent, etc. Therefore, if one wants to change the property of the ink, the modification can be made on (1) the composition of the ink and (2) the ratio of the components in the ink. The ink design can thus be achieved by changing these two properties.

In conventional design, it can't identify whether an ink stored in the ink-jet cartridge is the original factory ink or not by the material property of the ink. The instant invention provides a further detector in conventional design of the print head and the detector cooperates with an identifiable ink, adding a special additive thereinto or changing the composition thereof, for achieving the goal of identifying whether the ink is the original factory ink or not and it will be customers' and manufacturers' great advantages.

SUMMARY OF THE INVENTION

It is thus an object of the present invention to provide a method of identifying ink stored in an ink-jet cartridge. It provides an identifiable ink by adding a special additive such as salt additive or acid additive into the ink or changing the composition of the ink or the ratio of the components in the ink. Furthermore, the ink further cooperates with an apparatus of identifying ink stored in an ink-jet cartridge to avoid the shortcomings of using the refill ink to damage the print head and of lowering the amounts of using the print head. Moreover, changing the material property of the ink can be achieved easily and it will not affect the print quality of the ink-jet printing.

Another object of the invention is to provide an apparatus of identifying ink stored in an ink-jet cartridge. The apparatus cooperating with an identifiable ink can achieve the goal of identifying whether the ink is the original factory ink or not, and the design in the print head is almost no need to change, so the design will be quite simple.

An apparatus of identifying ink stored in an ink-jet cartridge disclosed by this invention, which comprises:

- an ink reservoir, which is a container for storing the ink and has at least one orifice for the ink to flow out through the orifice;
- a print head, which is connected to the orifice of the ink reservoir to jet the ink in the ink reservoir to process printing operation; and
- a detector, which is connected to the IC of the print head for detecting an electrical property such as resistance or capacitance of the ink.

The ink cooperating with the apparatus of identifying ink stored in the ink-jet cartridge is made by adding a special additive such as salt additive or acid additive or changing the composition thereof or changing the ratio of the components therein and is used for providing an identifiable ink and is capable of controlling the printer to work or not. The steps comprise:

a)using a detector to detect the electrical property of the ink;

b)judging whether the electrical property of the ink is in a predetermined range or not?

c)if the electrical property of the ink is in the predetermined range by judging on the step b), the ink is judged to be the original factory ink and then the printer is at the state of standing by; and d)if the electrical property of the ink is not in the predetermined range by judging on the step b), the ink is judged to be not the original factory ink and then the printer is not working.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the drawings which are for illustration only, and thus are not limitative of the present invention, and wherein.

DETAILED DESCRIPTION OF THE INVENTION

Method and apparatus of identifying ink stored in an ink-jet cartridge according to the instant invention is used for providing a detector to detect an electrical property such as resistance or capacitance of the ink and for providing a method of identifying ink stored in the ink-jet cartridge by changing the composition of the ink.

Figure 1:
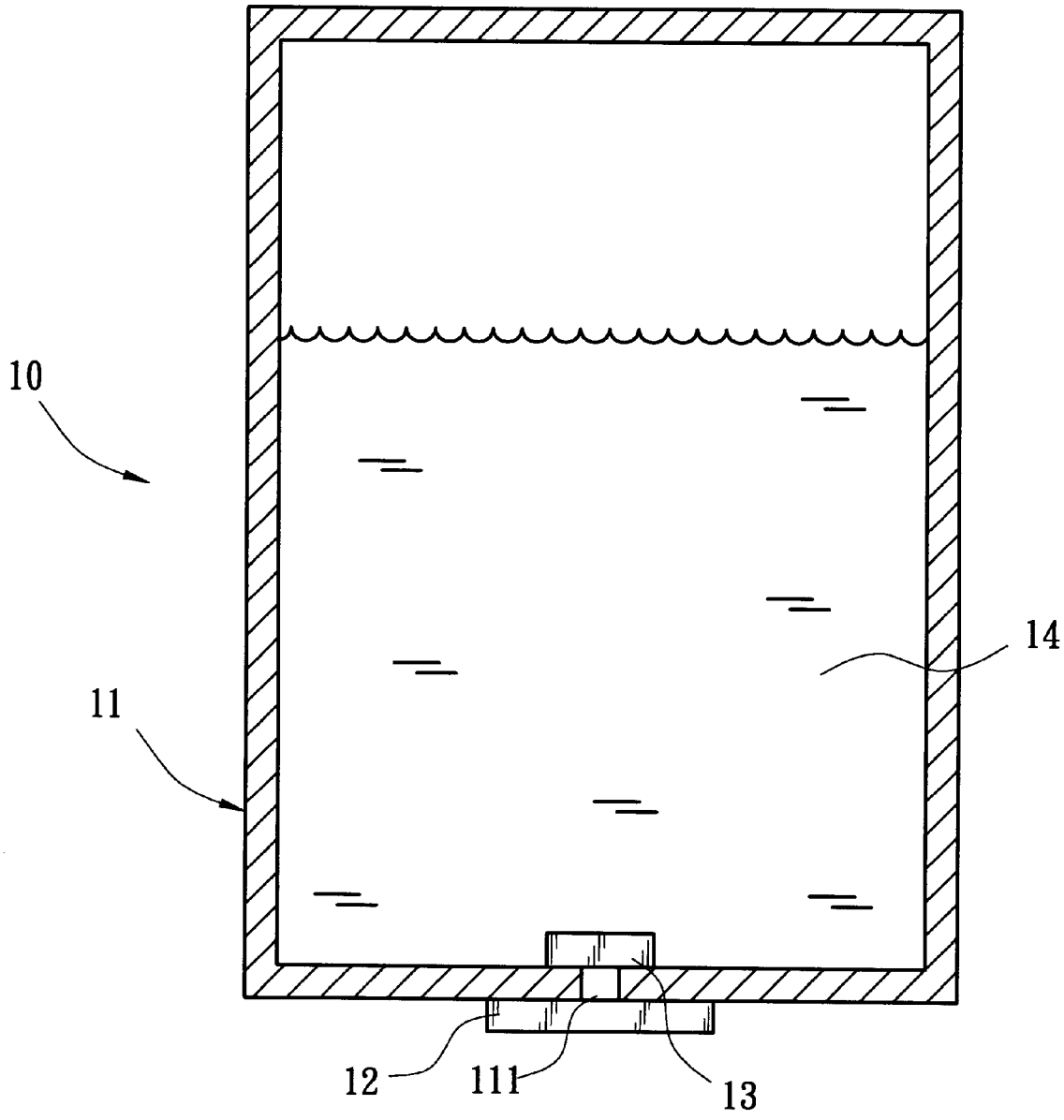
FIG. 1 is an illustrative diagram of the ink-jet cartridge of the present invention.

Referring now to FIG. 1, an illustrative diagram of the inkjet cartridge 10 of the present invention is shown. This cartridge 10 is used for identifying the ink 14 to control the printer (not shown in the figure) on which the ink-jet cartridge 10 is placed. The printer will be controlled to work or not. The cartridge 10 comprises:

- an ink reservoir 11, which is a container for storing the ink 14 and has at least one orifice 111 for the ink 14 to flow out through the orifice 111;
- a print head 12, which is connected to the orifice 111 of the ink reservoir 11 to jet the ink 14 in the ink reservoir 11 to process printing operation, wherein the print head 12 can eject the ink 14 out of the nozzle of the print head 12 by means of exerting an external pressure (such as utilizing a piezoelectric element) or vaporizing the ink 14 by heating from outside (such as utilizing the heat bubble method); and
- a detector 13, which is connected to the IC of the print head 12 for detecting an electrical property of the ink 14.

The ink 14 in the ink reservoir 11 which is so called the original factory ink is made by adding a special additive for changing the electrical property thereof and for providing an identifiable ink. For example, the additive can be a salt additive or an acid additive for lowering or rising the electrical property of the ink 14. When the detector 13 detects and obtains the value of the electrical property of the ink 14 and the value is not corresponding to a predetermined range, the detector 13 outputs a signal corresponding to the detected value for controlling the printer not working, wherein the detected value of the electrical property is the resistivity or the dielectric constant of the ink. Furthermore, to change the composition of the ink 14 and the ratio of the components in the ink 14 also can achieve the same goal.

The First Embodiment

Figure 2B:
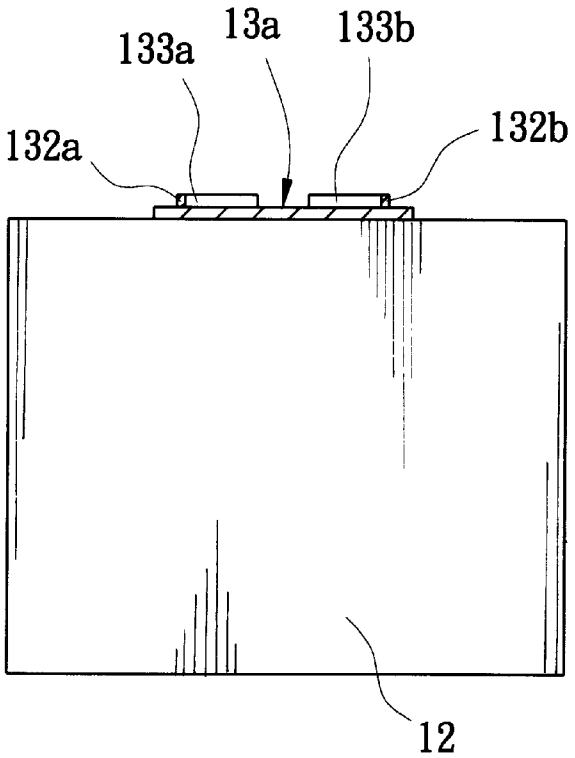
FIG. 2B is a sectional view of FIG. 2A showing the detector.
Figure 2A:
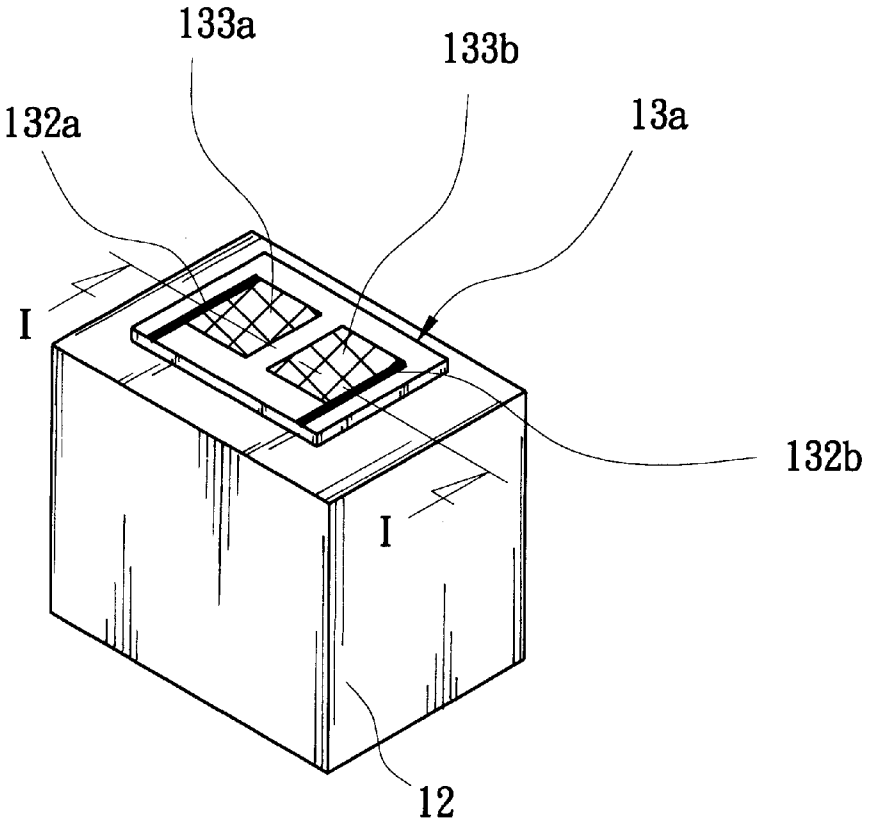
FIG. 2A shows a first embodiment of the detector of the ink-jet cartridge according to the invention.

Referring to FIG. 2A, shows a first embodiment of the detector 13*a* of the ink-jet cartridge 10 according to the invention, wherein the detector 13*a* includes a pair of electrical plates 133*a*, 133*b* which are not connected and formed directly on the IC of the print head 12 by semiconductor process and a pair of electric wires 132*a*, 132*b* which are connected to the IC for detecting and obtaining the value of the electrical property of the ink 14. When the value of the electrical property of the ink 14 is not in a predetermined range, the ink 14 is judged to be not the original factory ink.

FIG. 2B is a sectional view of FIG. 2A showing the detector 13*a*. When detecting the capacitance of the ink 14, the two electrical plates 133*a*, 133*b* are viewed as two plate capacitors and the ink 14 is viewed as dielectric material, so the dielectric constant of the ink 14 can be changed according to the demand.

The Second Embodiment

Figure 3:
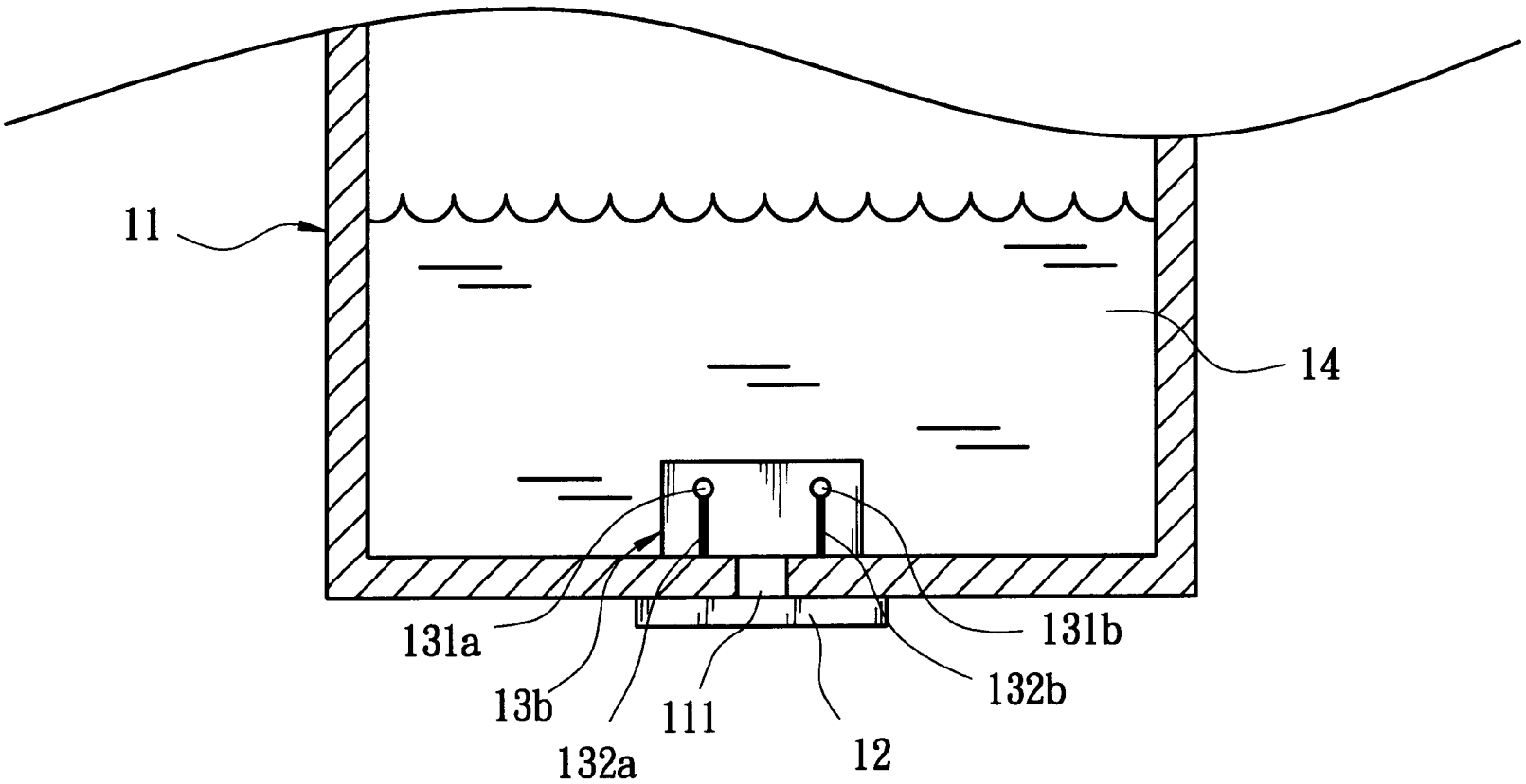
FIG. 3 shows a second embodiment of the detector of the ink-jet cartridge according to the invention.

Referring to FIG. 3, shows a second embodiment of the detector 13*b* of the ink-jet cartridge 10 according to the invention, wherein the detector 13*b* is printed on an inner surface of the ink reservoir 11 such as the bottom side of the ink reservoir 11 and includes a pair of electric wires 132*a*, 132*b* which are connected to the IC of the print head 12. Two circuits are printed on the detector 13*b*, and the top portions of the circuits are conductors 131*a*, 131*b*. While the height of the ink 14 is higher than the height of the conductors 131*a*, 131*b*, the electric loop is connected as to achieve the goal of detecting the electrical property of the ink 14. If the detected value of the electrical property of the ink 14 is not in the predetermined range, the ink 14 is judged to be not the original factory ink.

The Third Embodiment

Figure 4:
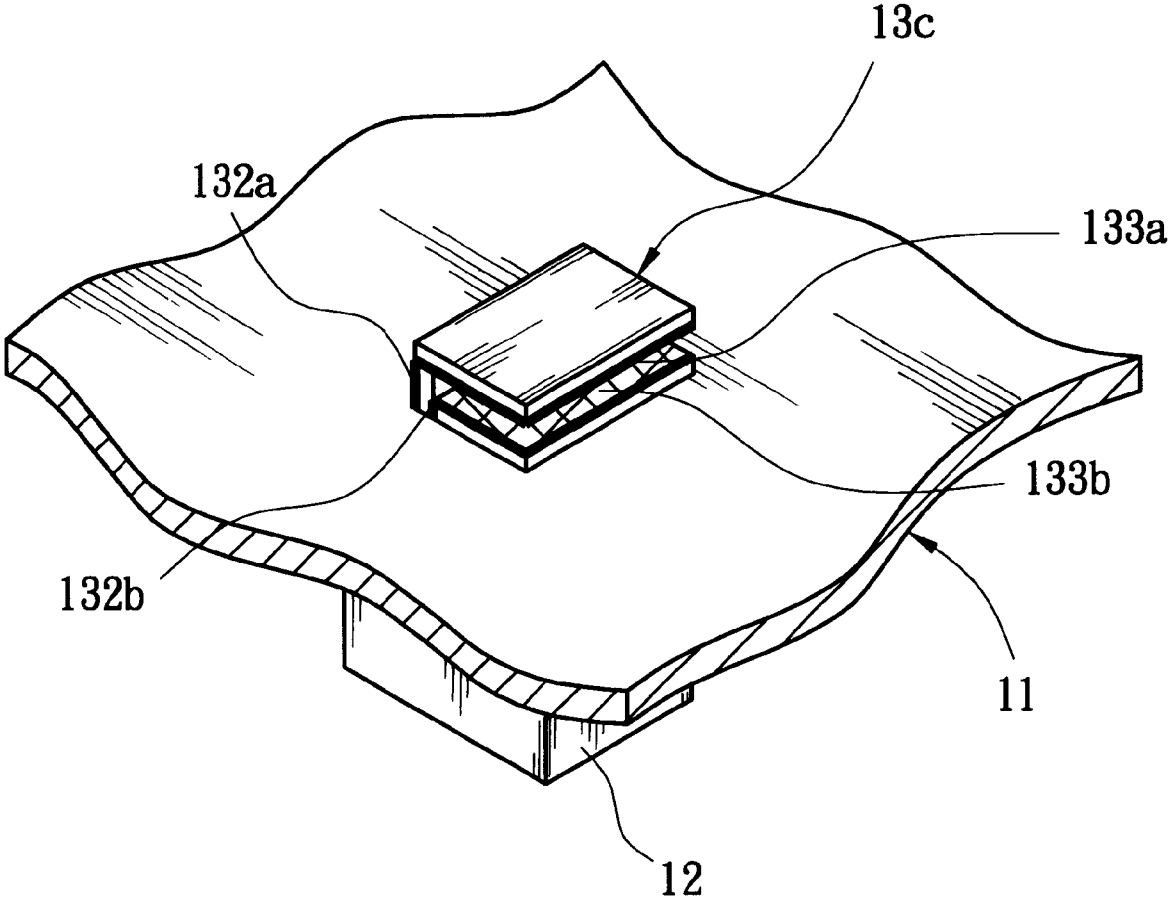
FIG. 4 shows a third embodiment of the detector of the ink-jet cartridge according to the invention.

Referring to FIG. 4, a third embodiment of the detector 13*c* of the ink-jet cartridge 10 according to the invention is shown, wherein the detector 13*c* is a C-shaped base structure and located at the bottom of the ink reservoir 11 and the base has two separated protrusions admitting the ink passing through, a pair of opposite electrical plates 133*a*, 133*b* which are at the inside surface of the protrusions and a pair of electric wires 132*a*, 132*b* which are connected electrical plates 133*a*, 133*b* to the IC of the print head 12 for detecting and obtaining the value of the electrical property of the ink 14. While the value of the electrical property of the ink 14 is not in a predetermined range, the ink 14 is judged to be not the original factory ink.

The Fourth Embodiment

Figure 5:
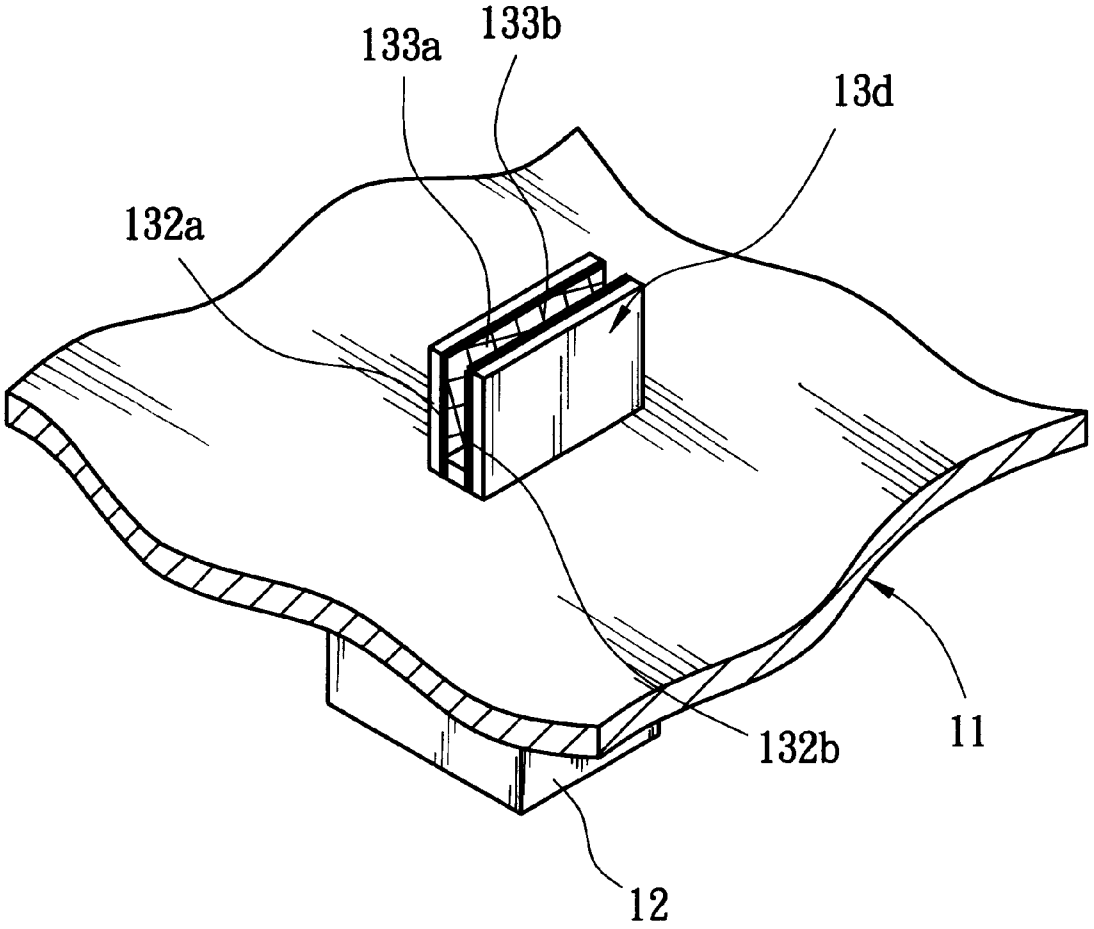
FIG. 5 shows a fourth embodiment of the detector of the ink-jet cartridge according to the invention.

Referring to FIG. 5, shows a fourth embodiment of the detector 13*d* of the ink-jet cartridge 10 according to the invention, wherein the detector 13*d* is a U-shaped base structure, having an opening upward, and located at the bottom surface of the ink reservoir 11 and the base has two separated protrusions admitting the ink passing through, a pair of opposite electrical plates 133*a*, 133*b* which are at the inside surface of the protrusions and a pair of electric wires 132*a*, 132*b* which are connected electrical plates 133*a*, 133*b* to the IC of the print head 12 for achieving the same goal of the third embodiment.

The Floating Chart

Figure 6:
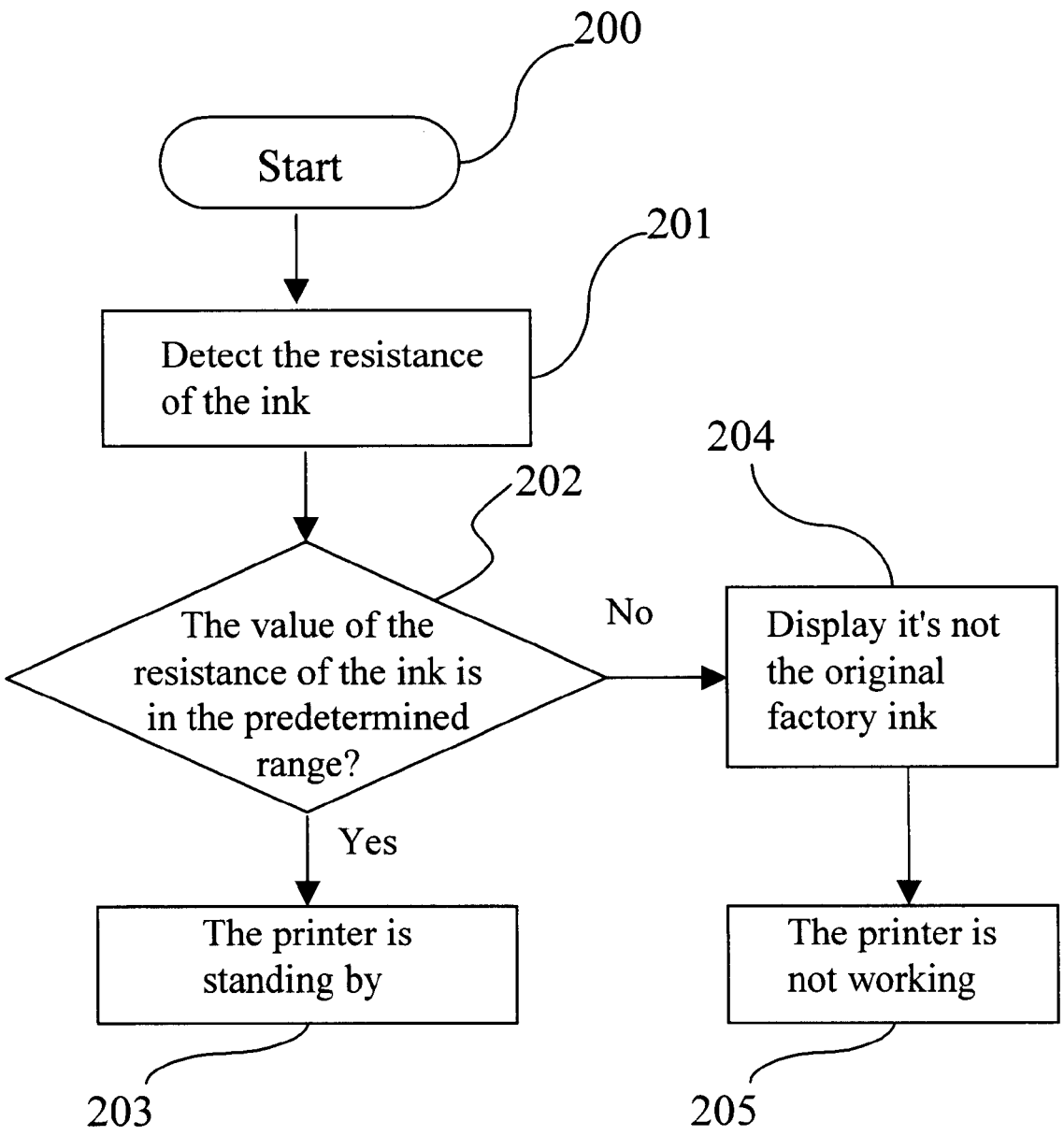
FIG. 6 shows a flow chart for identifying ink stored in an ink-jet cartridge by detecting the resistance of the ink.

Referring now to FIG. 6, a flow chart for identifying ink 14 stored in an ink-jet cartridge 10 by detecting the resistance of the ink 14 is shown. The steps comprise:

a)using the detector 13 to detect the resistance of the ink 14 (step 200~201);

b)judging whether the value of the resistance of the ink 14 is in a predetermined range or not (step 202)?

c)if the value of the resistance of the ink 14 is in the predetermined range by judging on the step b), the ink 14 is judged to be the original factory ink and then the printer is at the state of standing by (step 203); and d)if the value of the resistance of the ink 14 is not in the predetermined range by judging on the step b), the ink 14 is judged to be not the original factory ink and then the printer is not working (step 204~205).

As mentioned above, judging whether the value of the resistance detecting and obtaining by the detector 13 is in the predetermined range or not, i.e. identifying whether the ink 14 stored in the ink-jet cartridge 10 is the original factory ink or not, if the original factory ink is not present, then the printer is not working.

Figure 7:
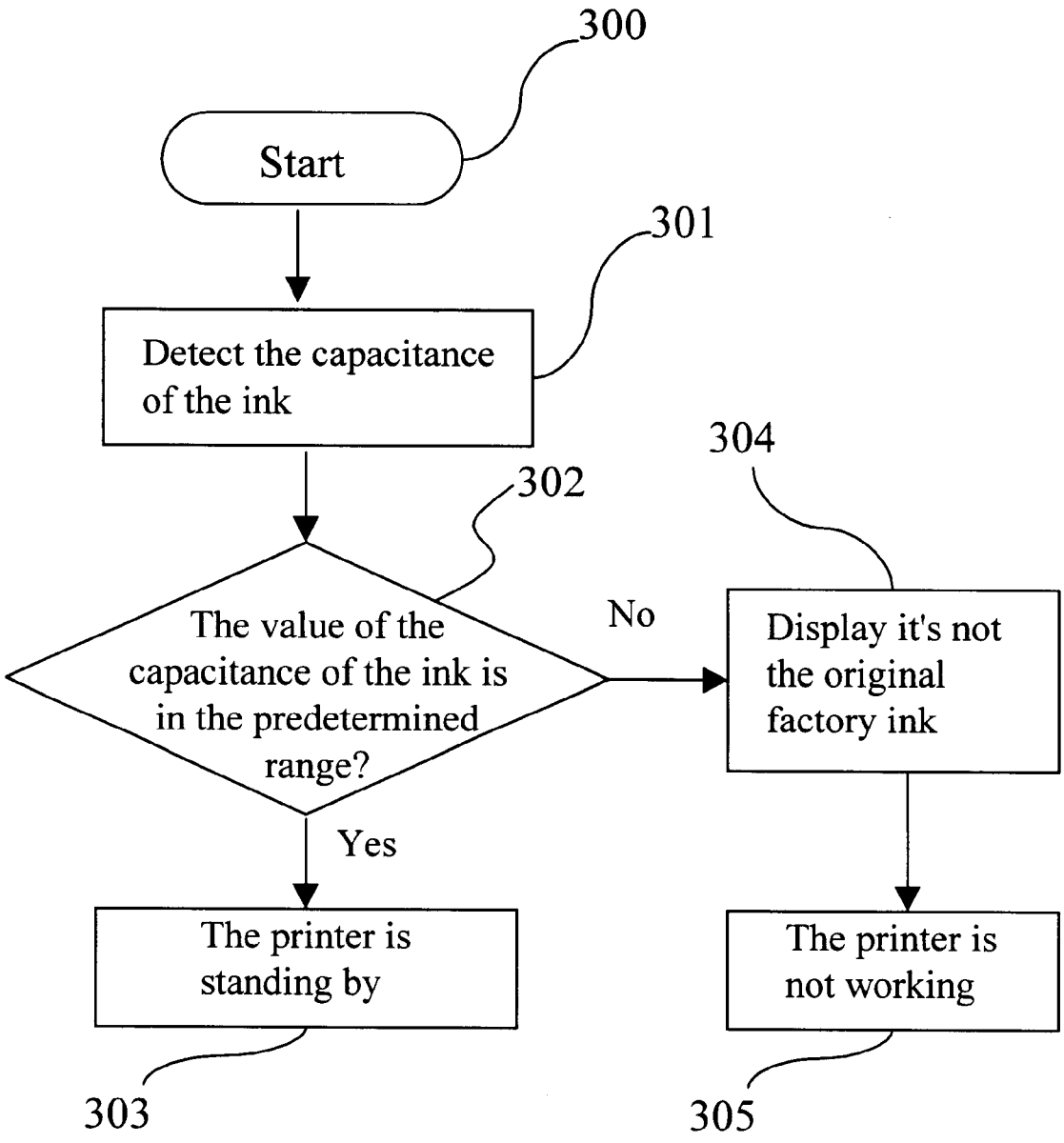
FIG. 7 shows a flow chart for identifying ink stored in an ink-jet cartridge by detecting the capacitance of the ink.

Referring to FIG. 7, a flow chart for identifying ink 14 stored in an ink-jet cartridge 10 by detecting the capacitance of the ink 14 is shown. The steps comprise:

a)using the detector 13 to detect the capacitance of the ink 14 (step 300~301);

b)judging whether the value of the capacitance of the ink 14 is in a predetermined range or not (step 302)?

c)if the value of the capacitance of the ink 14 is in the predetermined range by judging on the step b), the ink 14 is judged to be the original factory ink and then the printer is at the state of standing by (step 303); and d)if the value of the capacitance of the ink 14 is not in the predetermined range by judging on the step b), the ink 14 is judged to be not the original factory ink and then the printer is not working (step 304~305).

Method and apparatus of identifying ink stored in an ink-jet cartridge disclosed by this invention have the following advantages:

1. The invention provides one kind of ink by adding a special additive or changing the composition of the ink or the ratio of the components in the ink, and the ink further cooperate with an apparatus of identifying ink stored in an ink-jet cartridge to be an identifiable ink. It can avoid the shortcomings of using the refill ink to damage the print head and of lowering the amounts of using the print head.
2. The invention is to add a special material such as salt additive or acid additive into usual ink for changing the electrical property of the ink. It can be achieved easily and will not affect the print quality of the ink jet printing.
3. The invention provides an apparatus of identifying ink stored in an ink-jet cartridge, and the apparatus cooperating with an identifiable ink can achieve the goal of identifying whether the ink is the original factory ink or not. The design in the print head is almost no need to change, so the design will be quite simple.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of identifying ink stored in an ink-jet and for controlling a printer, the method comprises the steps of:

adding a salt additive to the ink for changing an electrical property thereof;

setting a predetermined range of the value of the electrical property for the ink;

obtaining a detected value of the electrical property of the ink by the detector;

outputting a corresponding signal to the printer according to the detected value by the detector;

disabling the printer when the detected value is not in the predetermined range; and enabling the printer to work when the detected value is in the predetermined range.

2. The method of identifying ink stored in an ink-jet cartridge according to claim 1, further comprising the step of forming the detector by a semiconductor process for fabricating a print head IC of the ink-jet cartridge.

3. The method of identifying ink stored in an ink-jet cartridge according to claim 1, further comprising the step of forming the detector by a printing process on an inner surface of a reservoir of the ink-jet cartridge connected to a print head IC of the ink-jet cartridge.

4. The method of identifying ink stored in an ink-jet cartridge according to claim 1, further comprising the step of forming the detector by including a pair of electrode plates.

5. The method of identifying ink stored in an ink-jet cartridge according to claim 1, further comprising the step of forming the detector by including a pair of protruded conductors.

6. The method of identifying ink stored in an ink-jet cartridge according to claim 1, wherein the value of the electrical property is resistivity of the ink.

7. The method of identifying ink stored in an ink-jet cartridge according to claim 1, where in the value of the electrical property is dielectric constant of the ink.

8. A method of identifying ink stored in an ink-jet and for controlling a printer, the method comprises the steps of:

adding an acid additive to the ink for changing the electrical property thereof;

setting a predetermined range of a value of the electrical property for the ink;

obtaining a detected value of the electrical property of the ink by a detector;

outputting a corresponding signal to the printer according to the detected value by the detector;

disabling the printer when the detected value is not in the predetermined range; and enabling the printer to work when the detected value is in the predetermined range.

9. The method of identifying ink stored in an ink-jet cartridge according to claim 8, further comprising the step of forming the detector by a semiconductor process for fabricating a print head IC of the ink-jet cartridge.

10. The method of identifying ink stored in an ink-jet cartridge according to claim 8, further comprising the step of forming the detector by a printing process on an inner surface of a reservoir of the ink-jet cartridge connected to a print head IC of the ink-jet cartridge.

11. The method of identifying ink stored in an ink-jet cartridge according to claim 8, further comprising the step of forming the detector by including a pair of electrode plates.

12. The method of identifying ink stored in an ink-jet cartridge according to claim 8, further comprising the step of forming the detector by including a pair of protruded conductors.

13. The method of identifying ink stored in an ink-jet cartridge according to claim 8, where in the value of the electrical property is resistivity of the ink.

14. The method of identifying ink stored in an ink-jet cartridge according to claim 8, wherein the value of the electrical property is dielectric constant of the ink.

15. An apparatus for identifying ink stored in an ink-jet cartridge and for controlling a printer, the apparatus comprising:

an ink reservoir which stores ink and has at least one orifice for the ink to flow out through;

a print head, the print head being connected to the orifice of the ink reservoir to jet the ink stored in the ink reservoir during a printing process operation; and a detector, the detector being connected to an IC of the print head for detecting an electrical property of the ink, the detector includes a pair of electrical plates which are not connected and are formed directly on the IC of the print head by a semi-conductor process, the detector detecting and obtaining a value of the electrical property of the ink.

16. The apparatus for identifying ink stored in an ink-jet cartridge according to claim 15, wherein the value of the electrical property is resistivity of the ink.

17. The apparatus for identifying ink stored in an ink-jet cartridge according to claim 15, wherein the value of the electrical property is dielectric constant of the ink.

18. The apparatus for identifying ink stored in an ink-jet cartridge according to claim 15, further comprising a piezoelectric element in the print head for jetting the ink.

19. The apparatus for identifying ink stored in an ink-jet cartridge according to claim 15, wherein a bubble heat method is used in the print head to vaporize the ink for jetting the ink.

20. An apparatus for identifying ink stored in an ink-jet cartridge and for controlling a printer, the apparatus comprising:

an ink reservoir which stores ink and has at least one orifice for the ink to flow out through;

a print head, the print head being connected to the orifice of the ink reservoir to jet the ink stored in the ink reservoir during a printing process operation; and a detector, the detector being connected to an IC of the print head for detecting an electrical property of the ink, the detector being located at a bottom of the reservoir and being constructed of a base, the base having two separated protrusions admitting ink therebetween and a pair of opposite electrical plates being on the inside of the protrusions, the pair of opposite electrical plates being connected to the IC of the print head for detecting and obtaining a value of the electrical property of the ink.

21. The apparatus for identifying ink stored in an ink-jet cartridge according to claim 20, wherein the value of the electrical property is resistivity of the ink.

22. The apparatus for identifying ink stored in an ink-jet cartridge according to claim 20, wherein the value of the electrical property is dielectric constant of the ink.

23. The apparatus for identifying ink stored in an ink-jet cartridge according to claim 20, further comprising a piezoelectric element in the print head for jetting the ink.

24. The apparatus for identifying ink stored in an ink-jet cartridge according to claim 20, wherein a bubble heat method is used in the print head to vaporize the ink for jetting the ink.

* * * * *